US006007382A

United States Patent [19]

Wu

[11] Patent Number: 6,007,382

[45] Date of Patent: Dec. 28, 1999

[54] ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/339,013

[22] Filed: Jun. 23, 1999

[30] Foreign Application Priority Data

Dec. 15, 1998 [TW] Taiwan ..... 87220869

[51] Int. Cl.[6] ..... H01R 13/648

[52] U.S. Cl. ..... 439/607; 439/567

[58] Field of Search ..... 439/567, 571, 439/572, 573, 607, 609

[56] References Cited

U.S. PATENT DOCUMENTS 5,266,038 11/1993 Nakamura ..... 439/607
5,637,014 6/1997 Sukegawa et al. ..... 439/607
5,772,453 6/1998 Tan et al. ..... 439/567
5,788,538 8/1998 Belopolsky et al. ..... 439/607
5,934,940 8/1999 Maranto et al. ..... 439/607
5,938,473 8/1999 Nishio et al. ..... 439/567

*Primary Examiner*—Gary F. Paumen
*Attorney, Agent, or Firm*—Wei Te Chung

[57] ABSTRACT

An electrical connector includes an insulative body enclosed in a shielding casing. The body includes a rear wall and a base section perpendicularly extending from the rear wall. The rear wall defines a plurality of T-shaped slots and the base section defines grooves in communication with the slots for receiving L-shaped contact elements therein. The casing has a top panel and two side panels extending from opposite edges thereof. A bottom panel formed between the side panels includes two sections extending from the side panels and confronting each other. Each bottom panel section has an extension formed on a free edge thereof serving as a board lock. A rear panel extends from a rear edge of the top panel and closes a rear opening of the casing. Two extensions are formed on a lower edge of the rear panel to serve as board locks.

10 Claims, 5 Drawing Sheets

ELECTRICAL CONNECTOR

BACKGROUND OF THE INVENTION

1. Field of the Invention

The present invention generally relates to an electrical connector, and in particular to a Universal Serial Bus (USB) connector.

2. The Prior Art

A USB connector is mounted to a circuit board for connecting an external device to the circuit board. The connector is often enclosed by a shielding casing made of metal for protecting the connector from electromagnetic interference (EMI). Examples of the connectors are disclosed in Taiwanese Patent Application Nos. 85202862, 85217217 and 86200240. The conventional connector has retention legs extending from the shielding casing for retaining the connector on a circuit board. The retention legs are formed by a stamping procedure whereby openings are formed in the casing, which hinders the EMI protection properties of the shielding casing.

The connector comprises contact elements inserted into slots defined in the connector. When engaging with the connector, a mating device exerts a mating force on the contact elements in the same direction that the elements are inserted into the connector whereby the contact elements may become inadvertently displaced causing interruption of signal transmission.

Thus, it is desirable to have an electrical connector that eliminates the problems discussed above.

SUMMARY OF THE INVENTION

Accordingly, an object of the present invention is to provide an electrical connector having excellent EMI shielding properties.

Another object of the present invention is to provide an electrical connector comprising board locks extending from the casing for securely retaining the connector on a circuit board.

A further object of the present invention is to provide an electrical connector comprising contact elements capable of resisting a mating force exerted thereon.

To achieve the above objects, an electrical connector in accordance with the present invention comprises an insulative body enclosed in a shielding casing. The body includes a rear wall and a base section perpendicularly extending from the rear wall. The rear wall defines a plurality of T-shaped slots and the base section defines grooves in communication with the slots for receiving L-shaped contact elements therein. The casing has a top panel and two side panels extending from opposite edges thereof. A bottom panel formed between the side panels includes two sections extending from the side panels confronting each other. Each bottom panel section has an extension formed on a free edge thereof serving as a board lock. A rear panel extends from a rear edge of the top panel and closes a rear opening of the casing. Two extensions are formed on a lower edge of the rear panel to serve as board locks.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
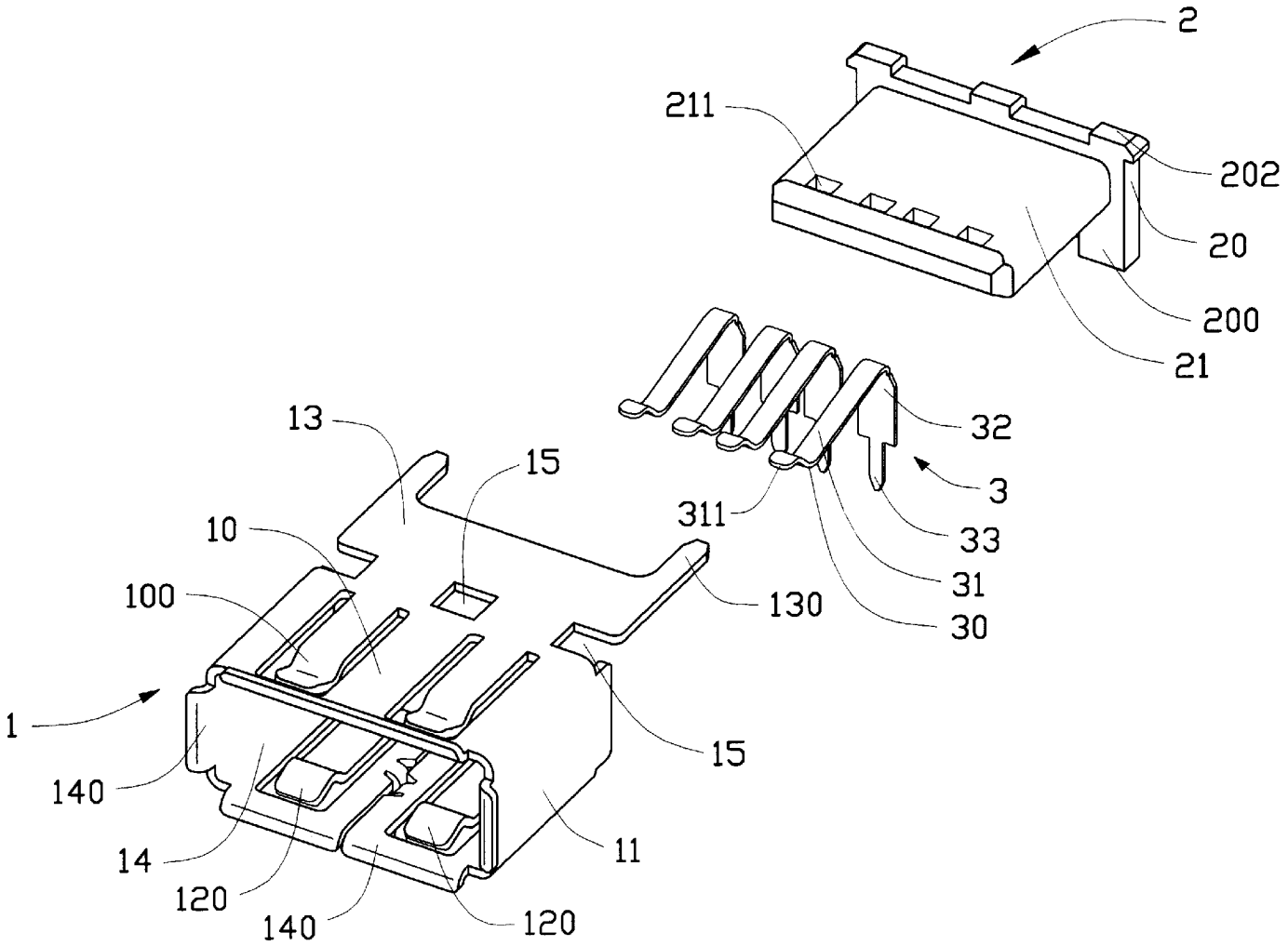
FIG. 1 is an exploded view of an electrical connector in accordance with the present invention.
Figure 2:
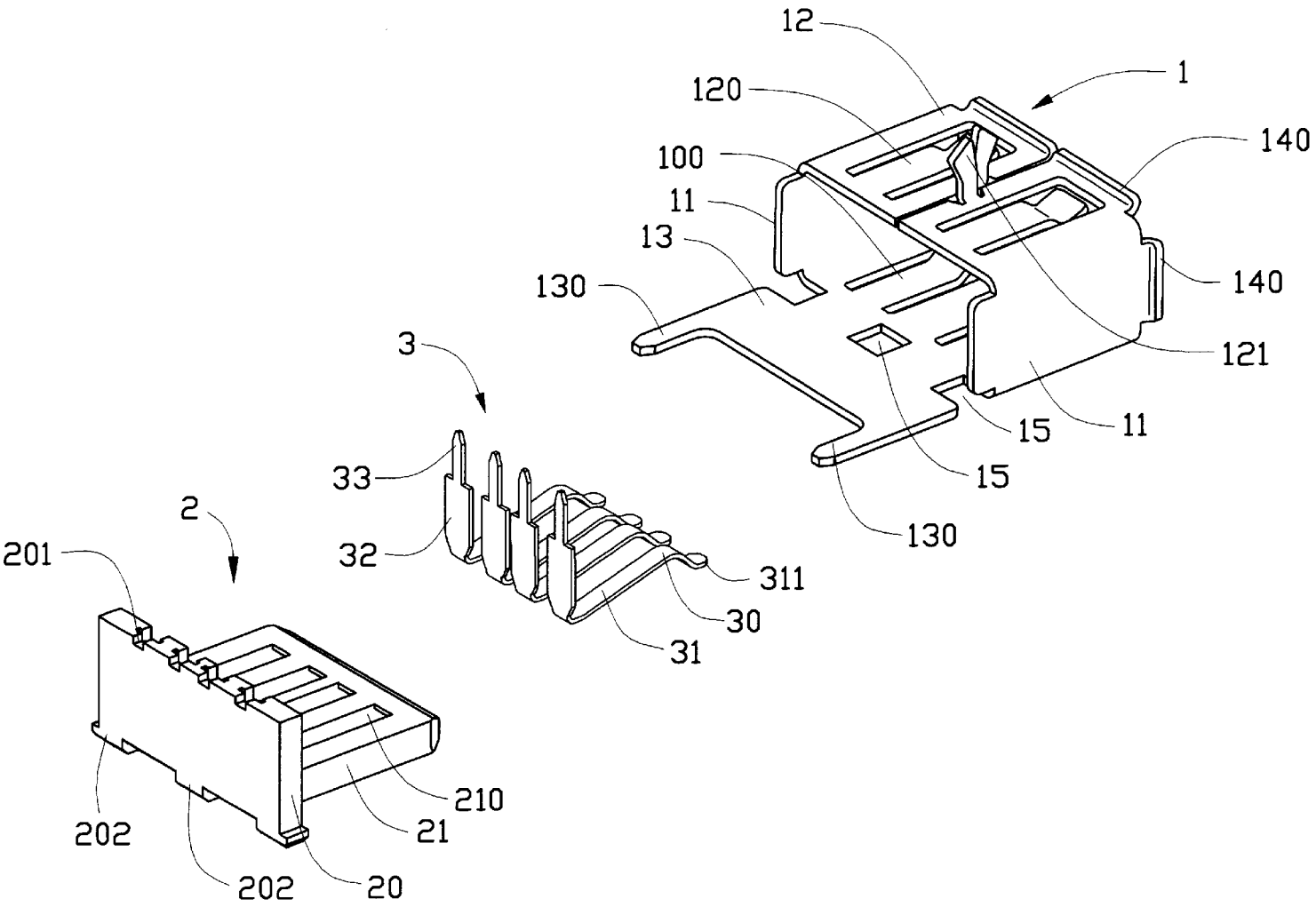
FIG. 2 is similar to FIG. 1 but taken from a different perspective.

Referring to the drawings and in particular to FIGS. 1 and 2, an electrical connector in accordance with the present invention comprises an insulative body 2 enclosed in a shielding casing 1 and a plurality of contact elements 3 retained in the body 2 and protected from external electromagnetic interference by the casing 1. The casing 1 comprises a top panel 10 and two side panels 11 extending from opposite edges thereof. A bottom panel 12 opposite and spaced from the top panel 10 comprises two sections (not labeled) extending from the side panels 11 and having free edges confronting each other thereby defining a receiving space 14 having a front opening (not labeled) for receiving a mating connector (not shown). Two first extensions 121 are formed on the free edges of the two sections of the bottom panel 12 and are arranged to be substantially normal to the bottom panel 12 for commonly serving as a board lock, wherein when such a board lock is solderably received within a corresponding hole of the substrate, the first extensions 121 of the two sections of the bottom panel 12 may also be permanently secured to each other, thus assuring reliable fastening of the enclosed body 2.

Two resilient arms 100, 120 are formed on both the top and bottom panels 10, 12 and partially extend into the receiving space 140 of the casing 1 for resiliently engaging with and retaining the mating connector. Preferably, each of the top, bottom and side panels 10, 12, 11 is provided with an outwardly extending flange 140 on a front edge thereof surrounding the front opening of the receiving space 14 for guiding the mating connector into the receiving space 14.

A rear panel 13 extends from an upper edge of the top panel 10 with a plurality of openings 15 defined therein. Two second extensions 130 are formed on a lower edge of the rear panel 13 and extend beyond the bottom panel 12 to serve as board locks.

Preferably, the casing 1 is formed by stamping a single piece of metal. The side panels 11 are bent 90 degrees with respect to the top panel 10 and the sections of the bottom panel 12 are further bent 90 degrees with respect to the side panels 11. The rear panel 13 is an extension of the top panel 10 and is bent 90 degrees to close a rear opening of the receiving space 14.

Figure 3:
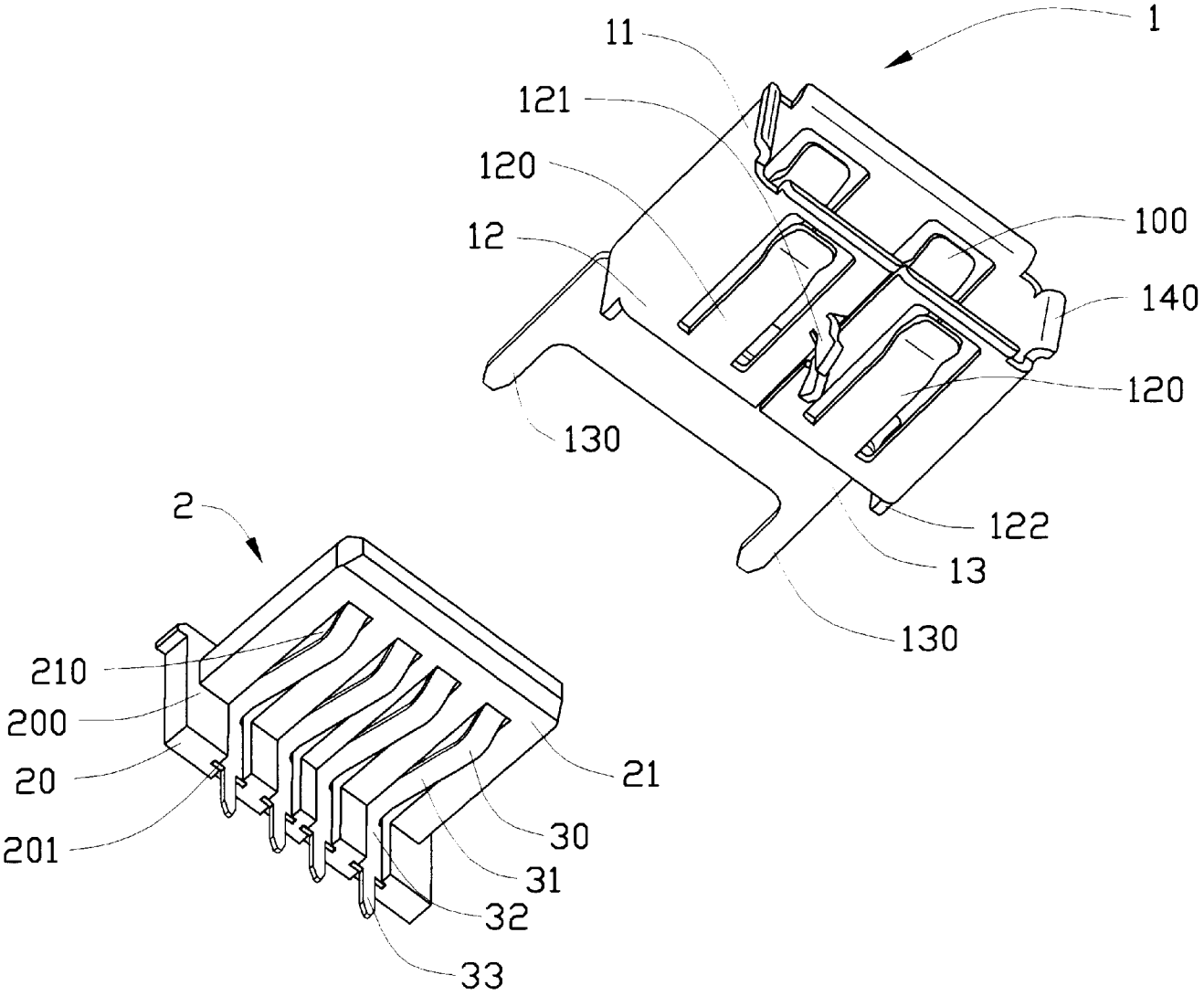
FIG. 3 is a partially assembled view of the electrical connector taken from another perspective.
Figure 4:
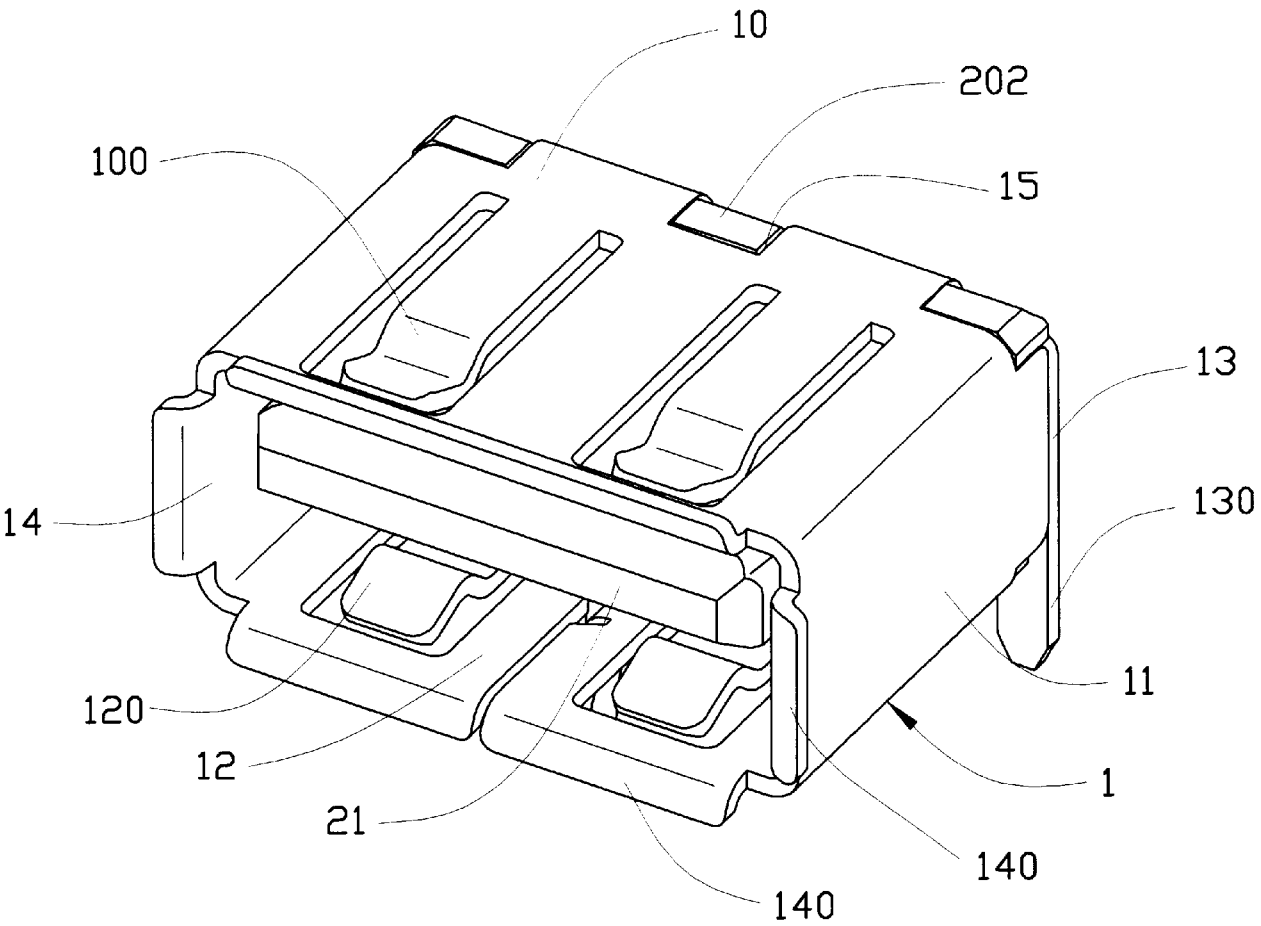
FIG. 4 is an assembled view of FIG. 1.
Figure 5:
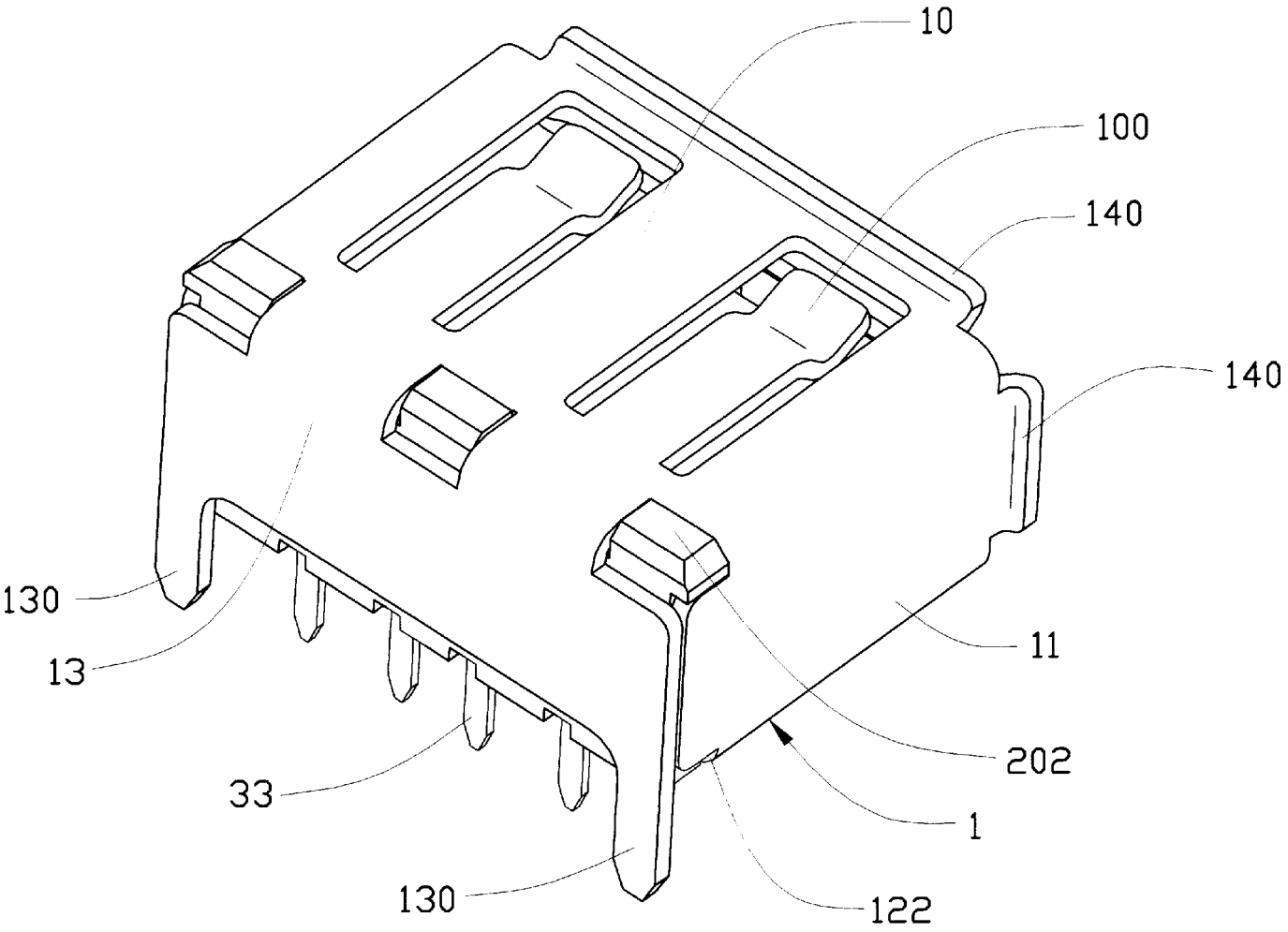
FIG. 5 is similar to FIG. 4 but taken from a different perspective.

The body 2 comprises a base section 21 perpendicularly extending from an inner face 200 of a rear wall 20. The rear wall 20 forms a plurality of projections 202 on an upper edge thereof for being received and retained in openings 15 defined between the rear panel 13 and the top panel 10 with the rear panel 13 abutting against the rear wall 20. The lower edge of the rear wall 20 is interposed between the rear panel 13 and a rear edge of the bottom panel 12 (FIG. 5) and exposed through a cutout 122 defined in the rear edge of the bottom panel 12 (FIGS. 3 and 5). The base section 21 of the body 2 extends into the receiving space 14 (FIG. 4).

A plurality of T-shaped slots 201 is defined in the rear wall 20 and exposed to the inner face 200 and a lower edge of the rear wall 20. A plurality of grooves 210 is defined in the base section 21 in communication with the T-shaped slots 201 for receiving and retaining the contact elements 3 therein.

Each contact element 3 comprises a fixed section 32 and a mating section 31 extending from the fixed section 32 to form an L-shape. The fixed section 32 is inserted into the corresponding T-shaped slot 201 from the lower edge of the rear wall 20 and slides along the T-shaped slot 201 until the mating section 31 thereof is received in the corresponding groove 210 of the base section 21. The T-shaped slot 201 securely fixes the contact element 3 in a direction parallel to the base section 21 which is substantially the direction that the mating connector is inserted into the receiving space 14 whereby excellent resistance against a mating force exerted thereon by the mating connector is obtained.

The mating section 31 of each contact element 3 forms a convex portion 30 which projects beyond the base section 21 thereby facilitating engagement with the mating connector. The fixed section 32 of each contact element 3 has a tail 33 extending beyond the bottom panel 12 of the casing 1 (FIG. 5) for electrically engaging with a circuit board (not shown).

Preferably, a plurality of holes 211 is defined through the base section 21 of the body 2 in communication with the corresponding grooves 210 for receiving a front end 311 of the mating section 31 of the corresponding contact element 3 for retaining the mating section 31 in position.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative body retaining contact elements therein; and a shielding casing comprising a top panel, two side panels extending from opposite edges of the top panel and a bottom panel formed between the side panels, a space being defined therebetween for accommodating the insulative body therein, the space having a front opening adapted to receive a mating connector electrically engaged with the contact elements and a rear opening closed by a rear panel formed between the top, bottom and side panels, at least one extension being formed on a lower edge of the rear panel and extending beyond the bottom panel to serve as a board lock, wherein the bottom panel comprises two sections extending from the side panels with free edges of the sections contacting each other, each section of the bottom panel comprising an extension formed on the free edge thereof for serving as one=half of a board lock.

2. The electrical connector as claimed in claim 1, wherein the rear panel comprises two extensions formed on the lower edge thereof.

3. The electrical connector as claimed in claim 1, wherein the side panels integrally extend from the edges of the top panel, and wherein the bottom panel comprises two sections integrally extending from the side panels with free edges of the sections confronting each other.

4. The electrical connector as claimed in claim 1, wherein the rear section integrally extends from a rear edge of the top panel and covers the rear opening.

5. The electrical connector as claimed in claim 4, wherein the body comprises a rear wall abutting against the rear panel, the rear wall having a top edge forming projections thereon for being received in openings defined between the rear panel and the top panel and a lower edge interposed between a rear edge of the bottom panel and the rear panel thereby securing the body in the casing, the body further comprising a base section extending from the rear wall and located in the space, a plurality of grooves being defined in the base section for receiving and retaining contact elements therein.

6. The electrical connector as claimed in claim 5, wherein a plurality of T-shaped slots are defined in the rear wall in communication with the grooves of the base section, each contact element comprising a fixed section received in the corresponding T-shaped slot and a mating section extending from the fixed section for being received in the corresponding groove of the base section.

7. The electrical connector as claimed in claim 6, wherein the fixed section of each contact element comprises a tail extending therefrom beyond the bottom panel.

8. The electrical connector as claimed in claim 6, wherein the mating section of each contact element forms a convex portion projecting beyond the base section for electrically engaging with the mating connector.

9. The electrical connector as claimed in claim 6, wherein the mating section has a free end received and retained in a hole defined in the base section for retaining the mating section in position.

10. An electrical connector comprising:

an insulative body retaining a plurality of contacts therein;

a shielding casing comprising a first panel, two side panels respectively extending from two sides of the first panel, and a bottom panel;

said bottom panel including two sections respectively extending from the two side panels toward each other and joined with each other at a line; wherein said two sections respectively define two complementary extensions along said line, and said two extensions cooperate with each other to commonly serve as a board lock to be receivably soldered within a hole of a substrate on which the bottom panel of the connector is seated, for not only securing the connector to the substrate but also securing the housing and the shielding casing together.

* * * * *